US005951200A

United States Patent [19]

Barton

[11] Patent Number: 5,951,200

[45] Date of Patent: Sep. 14, 1999

[54] ENCLOSEMENT TO SHIELD STRUCTURE WHICH SECURES ENTRANCE-DETERRING CAP TO MANHOLE OPENING FROM WATER AND DIRT CONTAINMENTS

[75] Inventor: David L. Barton, Avondale Estates, Ga.

[73] Assignee: Barton Southern Company, Inc., Conyers, Ga.

[21] Appl. No.: 09/026,161

[22] Filed: Feb. 19, 1998

Related U.S. Application Data

[63] Continuation-in-part of application No. 08/665,287, Jun. 17, 1996

[60] Provisional application No. 60/016,574, Apr. 30, 1996.

[51] Int. Cl.[6] ..... E02D 29/14

[52] U.S. Cl. ..... 404/25; 52/20

[58] Field of Search ..... 404/25, 26, 4; 52/19, 20; 210/163, 164

[56] References Cited

U.S. PATENT DOCUMENTS

| | | | |
|---|---|---|---|
| 3,973,856 | 8/1976 | Gaglioti | 404/25 |
| 4,650,365 | 3/1987 | Runnels | 404/25 |
| 4,919,564 | 4/1990 | Neathery et al. | 404/25 |
| 4,957,389 | 9/1990 | Neathery | 404/25 X |
| 5,253,952 | 10/1993 | Selway | 404/25 |
| 5,295,535 | 3/1994 | Boles et al. | 166/81 |
| 5,383,311 | 1/1995 | Strickland | 52/20 |
| 5,401,114 | 3/1995 | Guggemos | 404/25 |
| 5,727,351 | 3/1998 | Neathery et al. | 52/20 |
| 5,827,007 | 10/1998 | Barton et al. | 404/25 |

OTHER PUBLICATIONS

The "Rainstopper" brochure, Southwestern Packing & Seals, Shreveport, LA 71133–3997 (undated).

Tetherlock™ Stainless Steel "Rainstopper" brochure, Southwestern Packing & Seals, Shreveport, LA 71149–0369 (undated).

Ultimate Stainless Steel "Rainstopper" brochure, Southwestern Packing & Seals Shreveport, LA 71149–0369 (undated).

Parson Manhole Insert brochure, Parson Environmental Products, Inc., Reading, PA 19606 (undated).

The Man–Pan brochure, PDS Technologies, Irwin PA 15642 (undated).

Knutson Manhole Inserts brochure and advertisement, J.C. Utility Sales, Inc. Dallas, TX 75238 (undated).

Fosroc® Sewer Guard brochure (undated).

Fosroc® Sewer Guard SD brochure (undated).

36" or 42" Watertight Manhole Brochure, Massaro MFG., Inc, Buena Park, CA 90620, (undated).

Manhole Seal Kit Model MSK–1, Massaro MFG., Inc., Buena Park, CA 90620, (undated).

*Primary Examiner*—James A. Lisehora

*Attorney, Agent, or Firm*—Kennedy, Davis & Hodge

[57] ABSTRACT

A cap formed with a pan that defines a central dish which receives a portion of the securing members that secure the pan to a manhole opening. A cover closes over the central dish to restrict entry of water and dirt contaminants into the central dish. The cover and the central dish thereby define an enclosure for the securing members which connect the cap to the manhole cover.

13 Claims, 5 Drawing Sheets

ENCLOSEMENT TO SHIELD STRUCTURE WHICH SECURES ENTRANCE-DETERRING CAP TO MANHOLE OPENING FROM WATER AND DIRT CONTAINMENTS

This application is a continuation-in-part of U.S. Ser. No. 08/665,287 filed Jun. 17, 1996 which application claims the benefit of U.S. Provisional Application No. 60/016,574, entitled Entrance-Deterring Cap For Manhole Openings filed Apr. 30, 1996 in the United States Patent and Trademark Office.

TECHNICAL FIELD

The present invention relates to a cap for closing manhole openings. More particularly, the present invention relates to a cap with an enclosement for shielding the structure which secures the cap to the manhole opening from contaminants.

BACKGROUND OF THE INVENTION

For many years, communication and power lines have been carried above ground on spaced-apart poles placed along streets and right-of-ways. The trend in recent years, however, has been to enclose these lines in conduits which are buried below ground. Interchanges of these conduits are typically housed in subsurface vaults formed of cast concrete walls which are accessible through manhole openings. Typically, the manhole opening to the subsurface vault is defined by an annular cast iron frame which is attached to the concrete walls of the vault. A cast iron disk-like cover sits on a flange of the frame for closing the manhole opening.

While the cover is satisfactory for closing the manhole opening into the vault, there are problems which arise from use of conventional manhole covers to close openings to subsurface vaults. These problems include lack of significant resistance to unauthorized entry into the vault through the manhole and also water and debris infiltration into the vault. While the manhole covers used to close the manhole openings are typically heavy cast-iron disks, they are readily removed with pry bars and with relatively insignificant exercise of labor. Thus, access into unsecured manholes is relatively quick, and the communications and power cables are thereby easily accessible and at risk to vandalism. The relatively easy access through conventional manhole openings into the vault poses problems, as concerns regarding security for communication and power lines increase. Conventional wire lines are shielded but can be damaged by laborious cutting with tools. In contrast, fiber-optic lines are rather easily cut and damaged in a short time. Thus unsecured covers pose security risks due to the potential for unauthorized, but relatively easy, entrance into the vault.

Further, entry of water and dirt through the manhole opening into the vault also poses problems. The accumulated water in the vault can become contaminated by both devices in the vault and seepage of chemicals and contaminates into the vault. Conventional covers for manhole openings typically do not form perfect seals on the frame and storm water often leaks through the opening into the vault. Contaminants such as lead may leach into the water that collects in the vault. When work is to be done in the vault, the accumulated water must first be collected and tested for contaminates prior to disposal. Any contaminated water must be treated according to hazardous material regulations prior to disposal. Storage, handling, and treatment of the collected vault water is expensive, time consuming, and labor intensive.

Various devices and methods have been used to deter and delay access to vaults through manhole openings. One approach involves tapping a threaded bore into both the rim of the cover and the perimeter of the frame in which the cover sits. A bolt is screwed into the bore and thereby secures the cover to the frame. With this approach, however, the manhole would continue to experience ingress of water and debris into the vault. My prior application Ser. No. 08/665,287 filed Jun. 17, 1996 in the United States Patent and Trademark Office discloses a cap which facilitates authorized entrance and passage through the manhole opening, for example into a cable vault, while deterring unauthorized entrance and reducing ingress of water and dirt. In this cap, portions of a securing structure are received within the pan which defines the cap. Particularly, the securing structure comprises an elongate bar which has a pair of plate rigidly attached at distal ends. A threaded stud rigidly attaches intermediate the plates. The threaded stud extends through an opening in the pan and is secured thereto with a nut. The plates bear against a lower surface of a frame of a manhole opening in order to secure the pan to the manhole opening. An elongate flexible strand rigidly attached at a distal end of the threaded stud extends through the opening, in order to couple the elongate bar with the pan. The nut is received on the strand within the pan. A handle is attached to a second end of the strand, for pulling the strand through the opening and thereby bringing the threaded stud through the opening into the pan. The threaded stud has a transverse bore in a distal portion for receiving a shackle of a padlock in order to lock the cap in a secured position to the manhole opening. While the cap has met a need for permitting entrance into subterranean vaults while deterring unauthorized entrance and reducing ingress of water and dirt into the vault, the pans collect water and dirt. Particularly, the conventional manhole covers which are received over the pan do not prevent water and dirt from entering into the cap. The water and dirt plug up the padlock and the threads of the stud. The dirt and water have to be cleaned away in order to unlock the padlock, remove the nut, and release the cap from being secured to the manhole opening, whereby entrance to the subterranean vault is obtained.

Accordingly, there is a need in the art for a cap which facilitates entrance through a manhole opening to a subterranean vault while restricting ingress of water and dirt contaminants therein and shielding such contaminants from the structure that secures the cap to the manhole opening. It is to such that the present invention is directed.

SUMMARY OF THE INVENTION

The present invention meets this need in the art by providing an entrance-deterring cap for manhole openings while reducing ingress of water and dirt and shielding the securing structures that hold the cap to the manhole opening from such contaminants. The entrance-deterring cap comprises an annular pan having a central dish and a skirt that defines a land portion and a taper portion. A cover attaches to the pan for closing over the central dish, and thereby restricting ingress of water and dirt into the central dish. The central dish encloses a portion of the securing structure that holds the pan to a frame of a manhole opening. An annular flange extends laterally from a distal lip of the skirt for supporting the pan on an upper edge of a frame in a manhole opening. A bottom of the central dish defines an opening therethrough for receiving a threaded stud. A securing member is disposed outwardly of the pan adjacent the bottom. In a preferred embodiment, the securing member is defined by an elongate cross-channel and a pair of perpendicularly disposed plates attached at respective distal ends of the cross-channel. A threaded stud rigidly attaches to the cross-channel medial the plates for insertion through the opening whereby the plates of the bar are disposed outwardly of the skirt with distal ends of the plates near the flange of the pan. A coupler connects the securing member to the pan. In a preferred embodiment, the coupler is a flexible cable that attaches to the threaded stud and extends into the pan through the opening therein. A nut is provided for threadingly engaging the stud within the pan in order to fasten the cross-channel of the securing member to the pan after the pan is positioned on a frame of a manhole opening. The pan, being supported by the flange on an upper surface of the frame in the manhole opening, is secured thereto by bearing the distal ends of the plates against a lower surface of the frame by engaging the nut to the stud within the pan. The cover closes the central dish and thereby shields the securing structure within the dish from water and dirt contaminants.

Objects, features, and advantages of the present invention will become apparent upon reading the following detailed description in conjunction with the drawings and the appended claims.

DETAILED DESCRIPTION OF THE PREFERRED EMBODIMENTS

Figure 1:
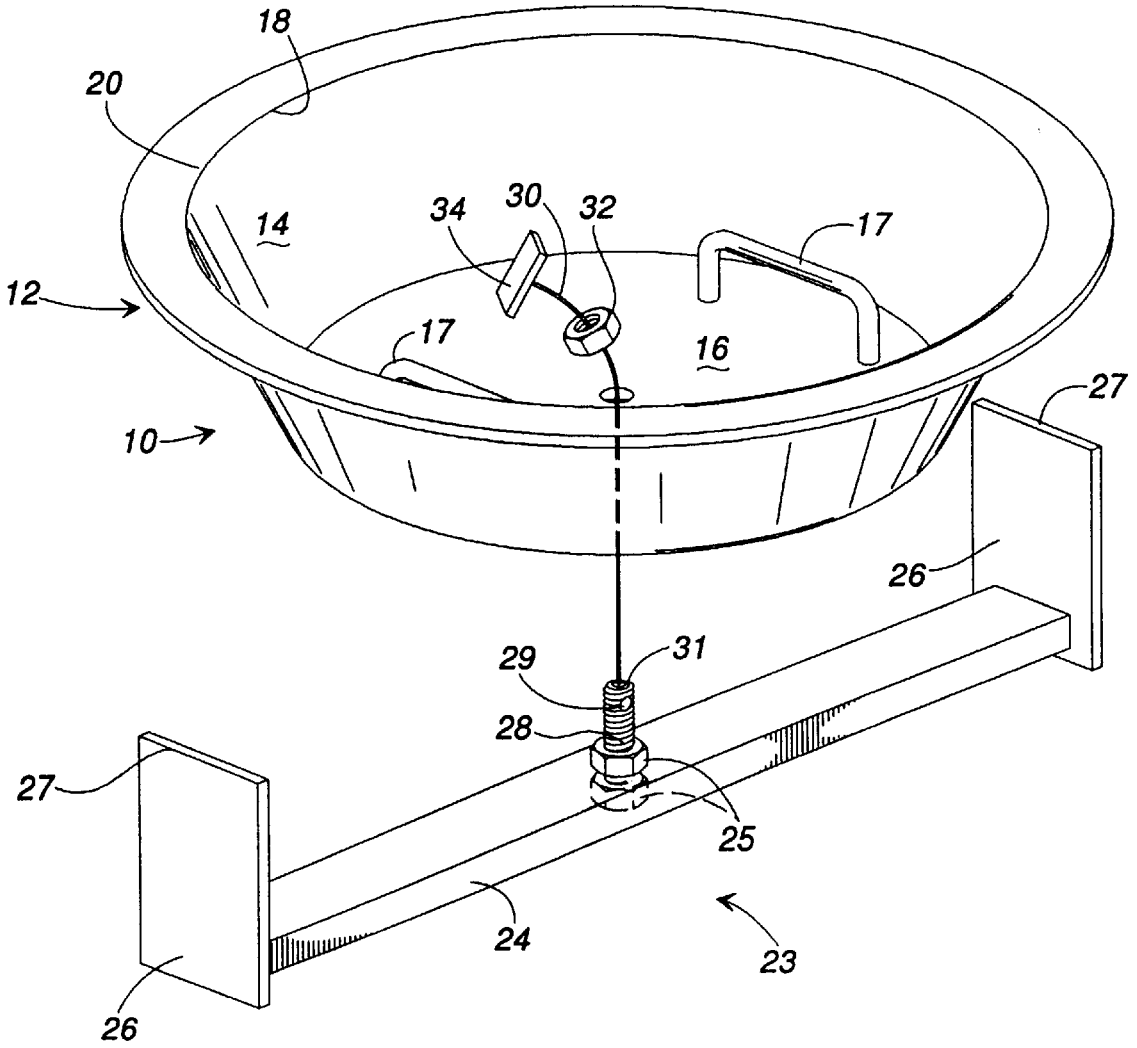
FIG. 1 is a perspective view of an entrance-deterring cap for a manhole opening, according to the present invention.

Referring now in more detail to the drawings, in which like numerals indicate like parts throughout the several views, FIG. 1 illustrates in perspective view an entrance-deterring cap for a manhole opening to a subsurface vault. The cap 10 comprises an annular pan 12 having a perimeter skirt 14 which tapers outwardly at an angle from a bottom 16 of the pan. An annular flange 20 extends laterally from a distal edge 18, or lip, of the skirt 14. The flange 20 supports the pan 12 on an upper edge of a frame in a manhole opening, as discussed below. The bottom 16 of the pan 12 defines an opening 22. In a preferred embodiment, the opening 22 is in the center of the bottom 16, for a purpose discussed below. A pair of spaced-apart U-shaped handles 17 rigidly connect to the bottom 16.

A support member generally designated 23 is disposed outwardly of the pan 12 adjacent the bottom 16. The support member 23 is used to secure the pan 12 to the frame in the manhole opening as discussed below. In the illustrated embodiment, the support member 23 is substantially U-shaped in cross-sectional view. The support member 23 has an elongate bar 24 that extends along a diameter of the bottom 16 of the pan 12. In a preferred embodiment, the bar 24 is a U-shaped channel. The bar 24 has a pair of flat plates 26 rigidly attached at respective distal ends of the bar. The plates 26 are perpendicular to a longitudinal axis of the bar 24. The plates 26 are disposed outwardly of the skirt 14. When the bar 24 is connected to the bottom 16, the distal ends 27 of the plates are near the flange 20 for securing the pan 12 to the frame of the manhole opening, as discussed below.

A threaded stud 28 rigidly attaches to the elongate bar 24. In a preferred embodiment, the stud 24 attaches medial the plates 26 for centrally balancing the bar about the stud. The stud 28 in the illustrated embodiment is a threaded rod that inserts through an opening in the bar 24 and rigidly connects to the bar with a pair of nuts 25. As discussed below, the stud 28 extends through the opening 22 in the pan 12 and engages a nut in order to secure the bar 24 closely to the bottom 16 of the pan while disposing the plates 26 outwardly of the skirt 14 with the distal ends 27 of the plates near the flange 20 of the pan. In an alternate embodiment, the stud 28 is a bolt which extends through the hole in the channel which defines the bar 24. The bolt is welded to the channel. In a preferred embodiment, the stud 28 includes a transverse bore 29 in a distal portion, for a purpose discussed below.

The support member 23 is coupled to the pan 12 by an elongate flexible strand 30. The strand 30 holds the support member 23 near the pan 12 after the pan is placed on the frame in the manhole opening, as discussed below. The strand 30 rigidly attaches at a first end 31 to a distal end of the threaded stud 28. The strand 30 extends through the opening 22 in the pan 12 and receives thereon a nut 32 for threadingly engaging the stud 28. A handle 34 attaches to a second end of the strand 30 to hold the nut 32 on the strand and to prevent the pan and the support member 23 from separating. The handle 34 is also used for pulling the strand 30 through the opening 22 and thereby for inserting the stud 28 through the opening into the pan 12. In a preferred embodiment, the strand 30 is a steel cable.

Figure 2:
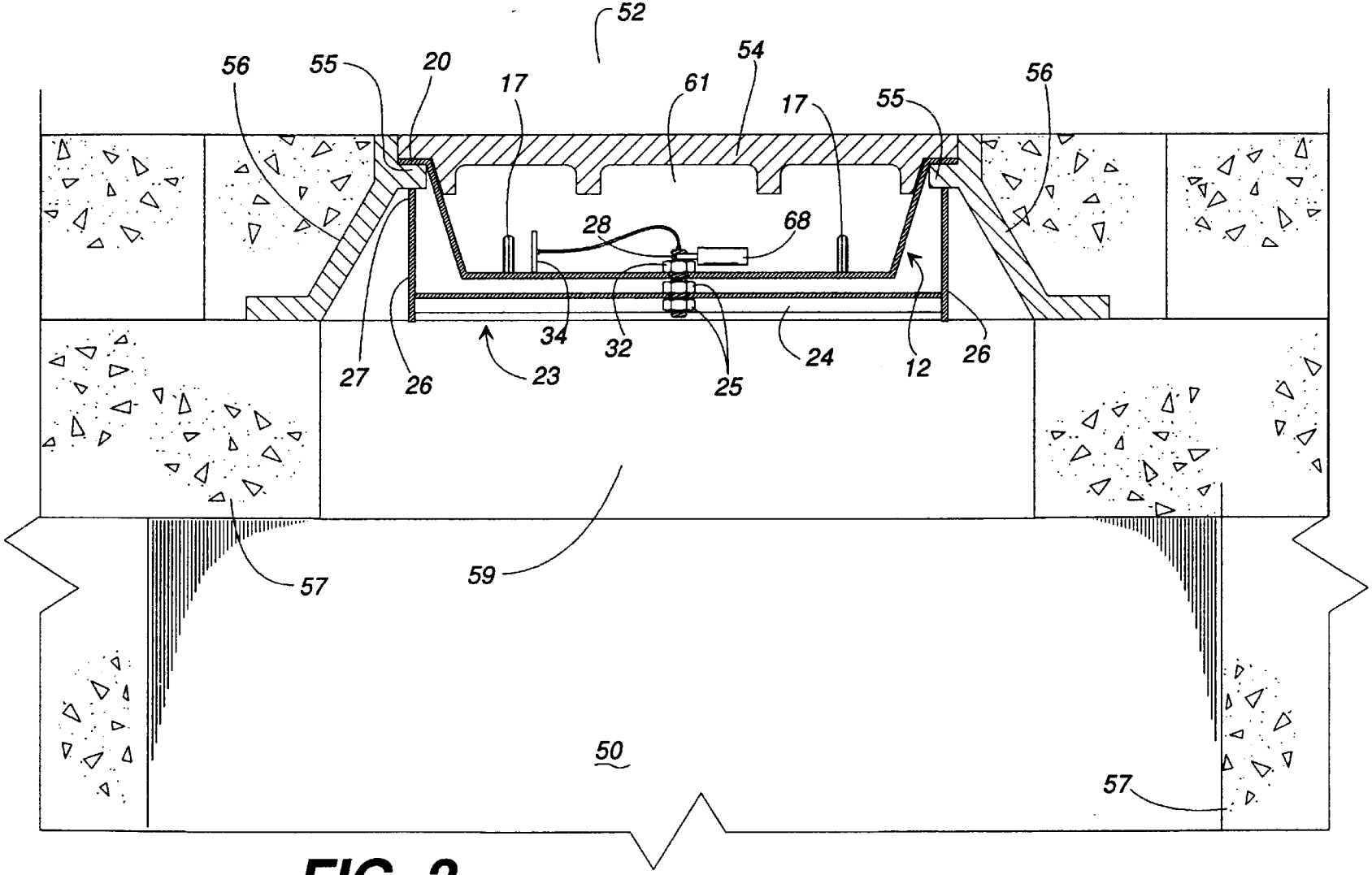
FIG. 2 is a cross-sectional view of a subsurface vault accessible through a manhole opening having the entrance-deterring cap illustrated in FIG. 1.

With reference to FIG. 2, the entrance-deterring cap of the present invention is used to deter entrance into a subsurface vault 50 through a manhole opening 52 which is closed conventionally by a manhole cover 54. In the illustrated embodiment, the vault 50 is formed with cement walls generally designated 57 which secures an annular frame 56 that defines the manhole opening 52. The manhole cover 54 sits on an annular flange-like lip 55 of the frame 56. The pan 12 and the support member 23 coupled to it are inserted into the manhole opening 52, by grasping the handles 17 in order to hold the pan 12 with the support member 23 suspended below by the stand 30. The support member 23 is inserted through the manhole opening 52 below the lip 55 of the frame 56. The support member 23, suspended by the flexible strand 30, hangs below the pan 12 in a throat 59 of the vault 50. Held by the handles 17, the pan 12 is positioned with the flange 20 supported on an upper surface of the lip 55. The pan 12 thereby closes the manhole opening 52 to the vault 50. The support member 23 is suspended on the strand 30 below the pan 12 in the throat 59.

The pan 12 thereafter is secured in place by connecting the support member 23 to the pan. Briefly, this involves moving the distal ends 27 of the plates 26 into engagement with a lower surface of the lip 55 of the frame 56 on which the pan 12 sits. Connecting the bar 24 to the pan 12 causes the distal ends 27 of the plates 26 to bear forcibly against the frame 56 and thereby lock the pan to the frame. In the illustrated embodiment, this is accomplished by first grasping the handle 34 and pulling, to pull the strand 30 through the opening 22 and the pan 12. The support member 23, preferably centrally supported from the stud 28 and thereby balanced, is readily pulled upwards towards the pan 12 by pulling the strand 30. The plates 26 are thereby disposed outwardly of the skirt 14 and the distal ends 27 of the plates 26 are moved into contact with the lower surface of the lip 55 of the frame 56 in which the pan 12 sits. The stud 28 is moved through the opening 22 and into an interior space 61 defined by the bottom 16 and the skirt 14 of the pan 12. The nut 32 slides down the strand 30 to the stud 28 and is threadingly engaged thereto to secure the bar 24 to the pan 12. This causes the distal ends 27 of the plates 26 to bear forcibly against the lower surface of the lip 55 and thereby lock the pan 12 to the frame 56.

As discussed above, the stud 28 further defines in a preferred embodiment the transverse bore 29. A shackle of a conventional padlock 68 inserts through the bore 29 after the nut 32 is tightened on the stud 28. Locking the padlock 68 prevents unauthorized removal of the nut 32 from the stud 28, and thereby secures the nut to the stud and deters entrance into the subsurface vault 50 through the manhole opening 52. The cap 10 accordingly is locked into the frame 56 to deter entrance into the vault 50. The manhole opening 52 is thereafter closed by positioning the conventional manhole cover 54 on the frame 56 of the manhole opening. In an alternate embodiment (not illustrated), a shroud encloses the padlock 68 when it is locked to the stud 28, for additional security. The shroud connects to the pan with bolts passing through bores in a flange of the shroud.

The pan 12 also resists entry of water and dirt into the vault 50 by trapping water and dirt in the cavity 61 between the bottom 16 of the pan and the manhole cover 54. In an alternate embodiment, the lower surface of the flange 20 includes a gasket to seal against water entry into the vault. The gasket is flexible to conform to surface irregularities of the lip 55 in the frame 56.

To gain access to the vault 50, the cover 54 is removed conventionally. The padlock 68 is removed, and the nut 32 unscrewed from the stud 28. The support member 23 is thereby detached from the locking the pan 12 to the frame 56. The strand 30 is slipped downwardly through the opening 22 to suspend the support member 23 below the pan 12. The pan 12 with the support member 23 is then lifted out of the manhole opening 52 by grasping and pulling on the handles 17 with the support member 23 following. One embodiment does not include the handles 17. The pan 12 is installed and removed by grasping the flange 20 of the pan 12.

In a preferred embodiment, a threaded rod secured by the nuts 25 is used for the stud 28. This enables an installer to adjust the length of the stud that extends outwardly of the bar 24, and thereby adjust the length of the stud that extends into the pan 12 through the opening 22. The cap 10 accordingly can be installed in manholes that have different frame structures and dimensions. Adjusting the length of the stud 28 allows the cap 10 to be installed on manhole frames 56 which have lips 55 of different thicknesses and enables the installer to use additional space in the cavity 61 if necessary between the bottom 16 of the pan 12 and the hole 29 in the stud 28 for receiving the padlock 68.

In one embodiment, the bottom 16 and the flange 20 of the pan 12 are manufactured from 14-gauge stainless steel and the skirt 14 is made of 16-gauge steel. The pan 12 however, can be made of cast iron or molded using a high-impact plastic. In another embodiment, the pan 12 is manufactured from a single sheet of stainless steel that is spun conventionally on a mandrel against rollers and formers to bend the sheet to the pan shape with the outwardly extending flange. For a conventional manhole opening of 31 inches, the bottom 16 of the pan 12 has a diameter of 29 and ½ inches. The pan 12 has a diameter of 31 and ⅜ inches, measured across the flange 20 at the open end of the pan. The depth of the pan 12 is 5 and ¾ inches. The bottom 16 includes a 1 inch hole centered in the bottom. The bar 24 is preferably a steel channel that is 1 inch by 2 inches and has a length of 31 and ⅛ inches, which slightly exceeds the diameter of a conventional 31 inch manhole opening, for engaging the lower surface of the frame 56 in the manhole opening 52. The plates 26 are ¼ inch by 2 inch by 7¾ inch flat stock steel plate. A ½ inch portion extends below the channel which defines the bar 24. The plates 26 are preferably welded to the distal ends of the channel. In an alternate embodiment, the stud 28 is defined by a bolt that is welded to the channel.

Figure 3:
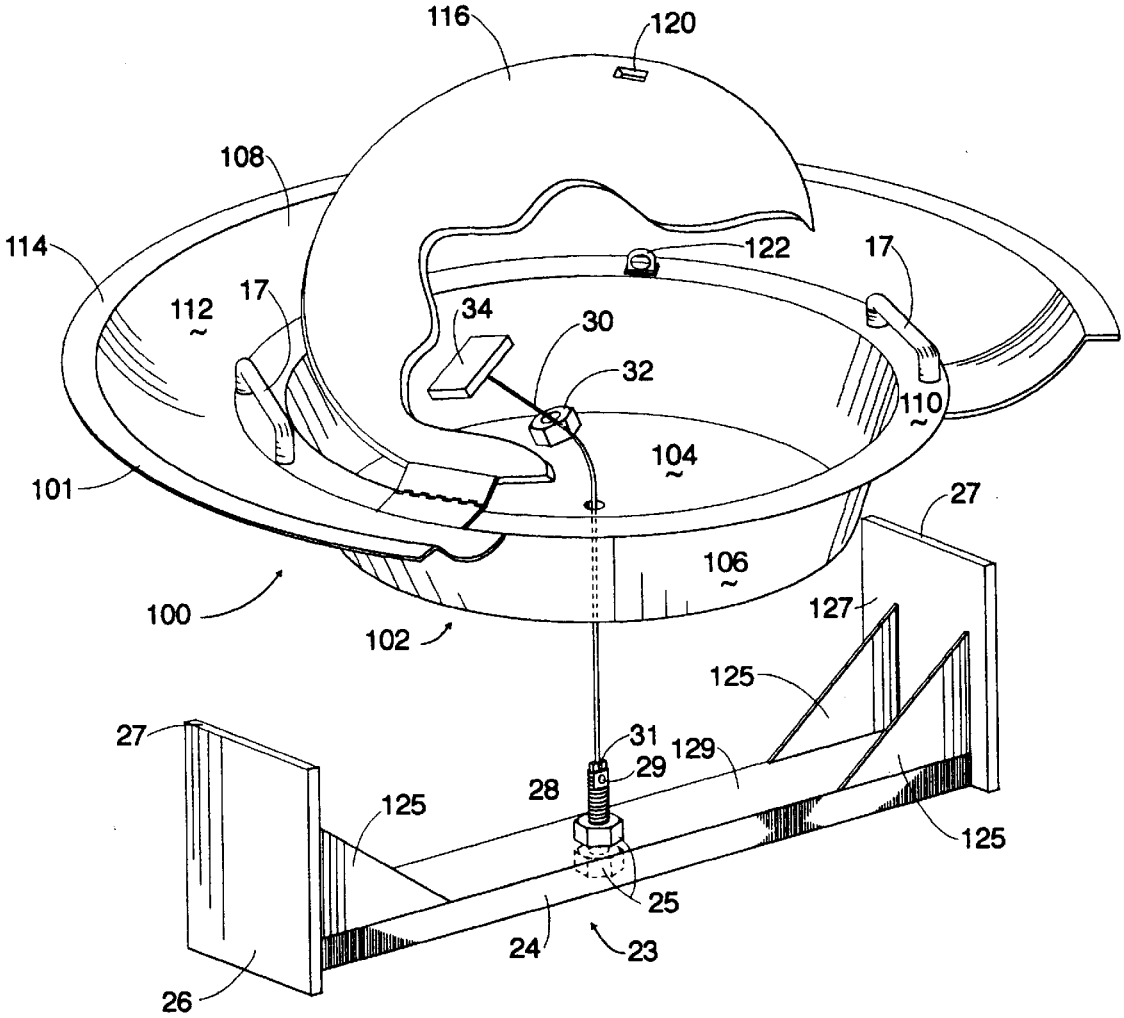
FIG. 3 is a perspective view of a second embodiment of an entrance-deterring cap for a manhole opening, according to the present invention.
Figure 4:
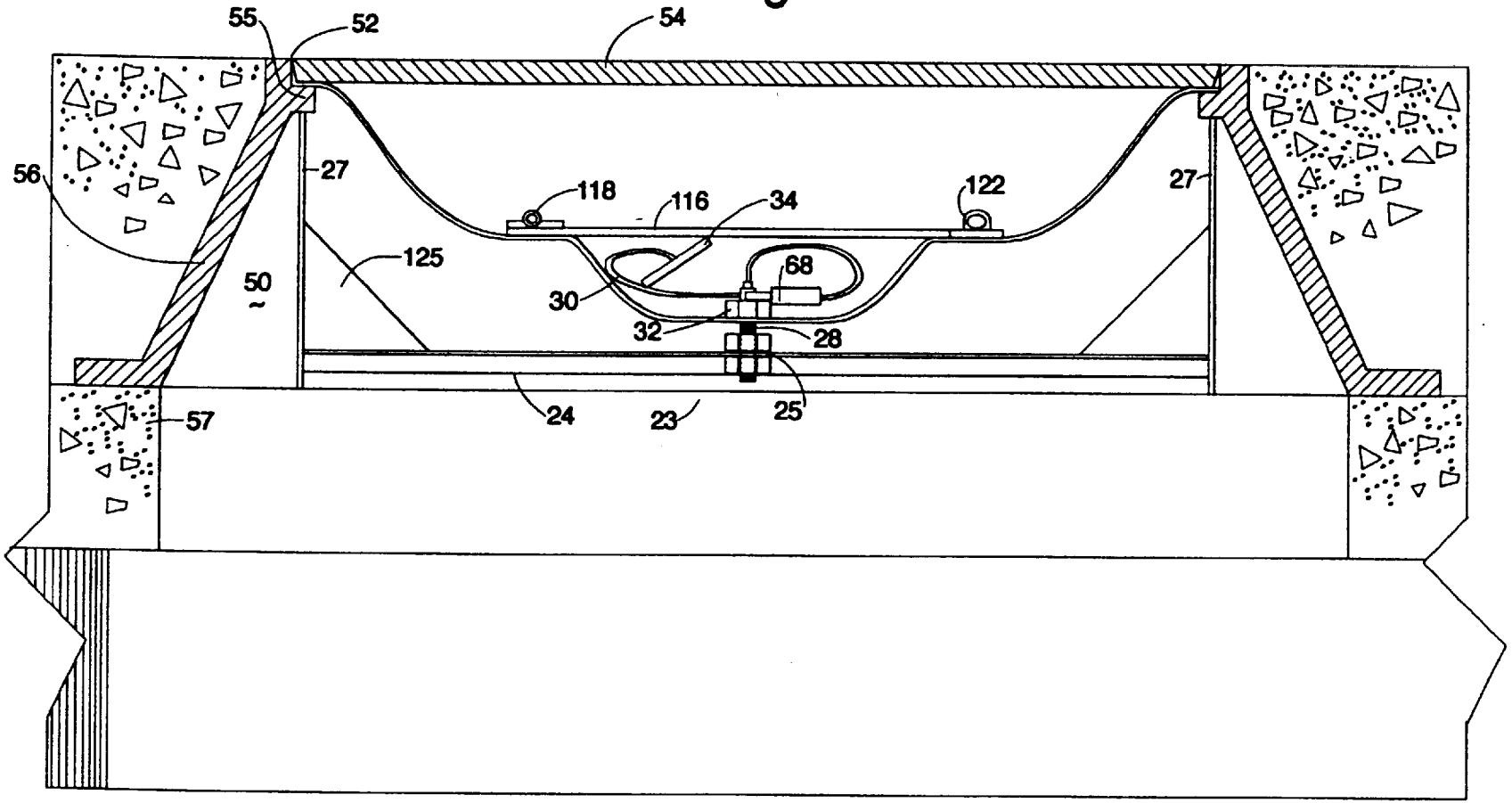
FIG. 4 is a cross-sectional view of a subsurface vault accessible through a manhole opening having the entrance-deterring cap illustrated in FIG. 3.

The cap 10 of the present invention is readily installed in manhole openings 52 and is readily removed for authorized entrance, while deterring unauthorized entrance and reducing water and dirt ingress into the vault 50 through the manhole opening 52. FIG. 3 illustrates in perspective view an entrance-deterring cap 100 for closing a manhole opening 56 to a subterranean vault 50 which cap further shields the securing structure 23 from water and dirt contaminants. The cap 100 comprises an annular pan 101 having a central dish 102 which defines a bottom 104 and sidewalls 106 which extend at a taper from the bottom. A skirt generally 108 extends from the edge of the sidewall 106 and defines a land portion 110 and a taper portion 112. An annular flange 114 extends laterally at a distal edge of the skirt 108 for supporting the pan 101 on the upper edge 55 of the frame 56 in a manhole opening. The bottom 104 of the central dish 102 defines a central opening 105 therethrough. The pan 100 is preferably formed of 12 gauge 304 stainless steel.

A coverplate 116 attaches with a hinge 118 to the land portion 110 of the pan 101. The coverplate 116 in the illustrated embodiment is a circular disk sized to cover the open central dish 102, and is preferably formed of stainless steel. Preferably, the coverplate 116 has perimeter portions coextensive with a portion of the land 110 around the central dish 102. A flexible gasket material 117 is attached to a lower surface of the coverplate 116. The gasket 117 seals the gap between the coverplate 116 and the land 110. The coverplate 116 also defines an opening 120. A closer 122 attaches to the land 110 in alignment with the opening 120 of the coverplate 116 when it is positioned against the land 110 in order to cover and close the dish 102. In the illustrated embodiment, the closer 122 is a hasp which rotates from a first position to a second position, whereby the hasp in the first position is received through the opening 120, and in the second position, is disposed transverse to the opening 120 for holding the coverplate 116 closed against the central dish 102. The support member 23 is described above with respect to FIG. 1. In the illustrated embodiment, however, gussets 125 rigidly interconnect between interior surfaces 127 of the plates 26 and the upper surface 129 of the elongate bar 24. These are preferably ¼ inch steel plates. In an alternate embodiment, the coverplate 116 is not hinged to the pan, but is secured over the central dish 102 with latches (not illustrated).

The cap 100 of the present invention is used to restrict ingress of water and dirt into the central dish 102 that holds portions of the support member 23, while the cap is used to deter entrance into the subsurface vault 50 through the manhole opening 52 closed conventionally by a manhole cover 54. The pan 101 and support member 23 coupled to it are inserted into the manhole opening 52 to position the flange 114 on the lip 55 of the frame 56. The U-shaped handles 17 are grasped to help insert the cap 100 into the manhole. The support member 23, suspended by the flexible strand 30, hangs below the pan 101 in a throat of the vault 50. The handle 34 is pulled in order to move the strand 30 through the opening 105. The stud 28 is pulled into the central dish 102. The nut 32 is threadingly engaged to the stud 28 to secure the bar 24 to the pan 101. The distal ends 27 of the plates 26 bear forcibly against the lower surface of the lip 55 and thereby lock the pan 101 to frame 56. A shackle of a conventional padlock 68 inserts through the bore 29 after the nut 32 is tightened on the stud 28. The padlock 65 prevents unauthorized removal of the nut 32 from the stud 28 and thereby locks the cap 100 into the frame 56 to deter entrance into the vault 50. The coverplate 116 is moved from a first position to a second position closing the central dish 102. The hasp 122 extends through the opening 120 as the cover 116 is positioned against the land 110. The seal 117 bears against the land 110 and seals the central dish 102. The hasp 122 is rotated to a second position to hold the cover closely against the land 110. It may be appreciated that the hasp 122 may further receive a second padlock, for the purpose of hardening the opportunity for illicit entrance through the manhole opening into the subterranean vault.

The cover 116 restricts ingress of water and dirt into the central dish 102 which encloses the threaded stud, the strand 30, the nut 32, and the padlock 68. The seal 117 further cooperatively restricts seepage of the water and dirt contaminants into the central dish 102 which enter into the cap 100 through gaps around the manhole cover 54. The pan 101 also resists entry of water into the vault 50 by trapping the water and dirt in the cavity generally 130 defined by the land 110, the taper portion 112, and the cover 116 of the cap 100.

Access to the vault 50 is obtained by removing the conventional cover 54. Any water or dirt in the cavity 130 is removed. The hasp 122 is rotated from the second position to the first position, whereby the coverplate 116 is openable by pivoting on the hinge 118. The padlock 116 is unlocked and removed from the threaded stud 28. The nut 32 is unthreaded from the stud 28 and the securing member 23 released from engagement with the frame 56 of the manhole opening.

Figure 5A:
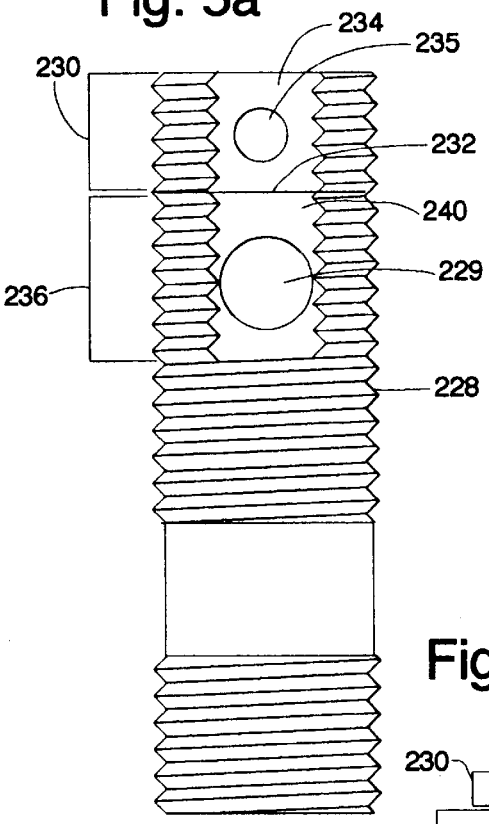
FIGS. 5*a*, 5*b*, and 5*c* are side views and a perspective view of an improved threaded stud for use with the entrance-deterring cap illustrated in FIGS. 1 and 3.
Figure 5B:
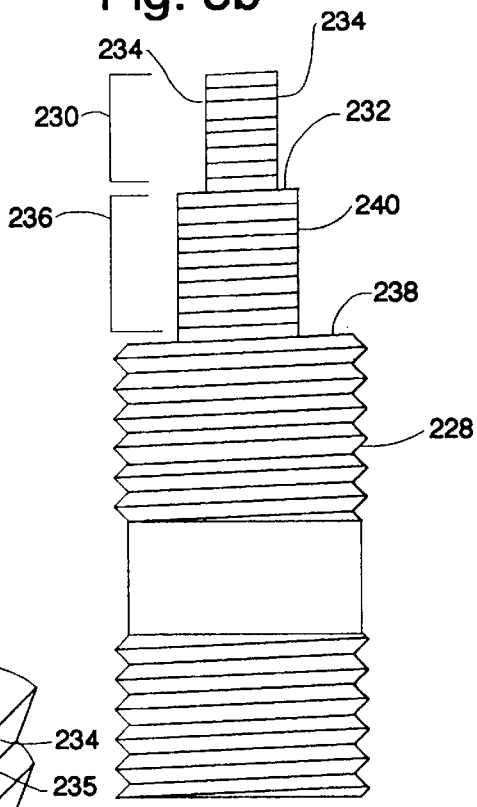
Figure 5C:
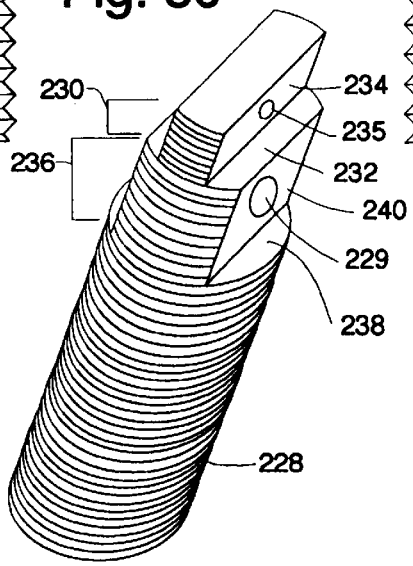

FIGS. 5*a*, 5*b*, and 5*c* illustrate side views and a perspective view of a preferred stud 228 for use with the entrance-deterring cap 10 and 100 illustrated in FIGS. 1 and 3 according to the present invention. The stud 228 faciliates insertion of the shakle of the padlock 68 through a bore 229. A distal end 230 of the stud 228 defines a first shoulder 232 and a side face 234 on opposing side of the stud. A bore 235 is defined in the distal end portion between the side faces 234. An intermediate portion 236 of the stud 228 defines a second shoulder and side face 240 on opposing sides of the stud. The bore 229 extends through the stud 228, preferably between the opposing side faces 240, for receiving the shakle of the lock 68. The shoulders 232, 238 and side faces 234, 240 result from machining the opposing sides of the stud 228. The stud 228 is connected to the flexible strand 30 which passes through the bore 235 and the end is secured thereto by a conventional clamp by welding, or by other mechanism, which permits the nut 32 to threadingly engage at the distal end and tighten to the stud 228.

The principles, preferred embodiments, and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as set forth in the following claims.

What is claimed is:

1. An entrance-deterring cap for manhole openings, comprising:

an annular pan having a central dish and a skirt extending therefrom, the skirt defining a land portion and a taper portion with an annular flange extending laterally at a distal edge of the skirt for supporting the pan on an upper edge of a frame in a manhole opening;

a coverplate which attaches to the pan to cover the central dish; and securing means for securing the pan on an upper surface of a frame in a manhole opening, said securing means at least partially received within the central dish, whereby the cover, being attached to the pan, substantially closes the central dish for restricting contaminants from the securing means therein.

2. The entrance-deterring cap as recited in claim 1, wherein the coverplate is hingedly attached to the land portion of the pan.

3. The entrance-deterring cap as recited in claim 1, further comprising a seal on a surface of the coverplate for sealing between the coverplate and the land portion of the skirt, whereby the seal restricts entrance of contaminants into the central dish.

4. The entrance-deterring cap as recited in claim 1, wherein the coverplate defines at least one opening in a perimeter portion; and further comprising a closer attached to the land portion in alignment with the opening, said closer being moveable from a first position for extending through the opening in the coverplate and a second position for securing the coverplate over the central dish.

5. The entrance-deterring cap as recited in claim 1, wherein the central dish has a bottom defining a central opening therethrough; and the securing means comprises:

a securing member defined by an elongate cross-channel and a pair of perpendicularly disposed plates attached at respective distal ends of the cross-channel, the securing member disposed outwardly of the pan adjacent the bottom of the central dish;

a threaded stud rigidly attached to the cross-channel medial the plates for insertion through the opening whereby the plates of the bar are disposed outwardly of the skirt with the distal ends of the plates near the flange of the pan;

a coupler connecting the securing member to the pan; and a nut for threadingly engaging the stud within the pan to fasten the bar to the bottom of the central dish, whereby the pan, being supported by the flange on an upper surface of a frame in a manhole opening, is secured thereto by bearing the distal ends of the plates against a lower surface of the frame by engaging the nut to the stud within the pan.

6. The entrance-deterring cap as recited in claim 5, wherein the threaded stud defines a transverse bore in a distal portion of the stud for receiving after the nut is engaged to the stud, a shackle of a padlock therethrough to prevent unauthorized removal of the cap.

7. The entrance-deterring cap as recited in claim 1, further comprising a pair of spaced-apart U-shaped handles rigidly connected to the pan, for grasping and holding the pan during installation and removal from a manhole opening.

8. An entrance-deterring cap for manhole openings, comprising:

an annular pan having a central dish and a skirt extending therefrom, the skirt defining a land portion and a taper portion with an annular flange extending laterally at a lip of the skirt for supporting the pan on an upper edge of a frame in a manhole opening, the central dish having a bottom defining a central opening therethrough;

a coverplate which attaches to the pan to cover the central dish;

an elongate bar disposed outwardly of the pan adjacent the bottom and having a pair of plates rigidly attached as respective distal ends of the bar;

a threaded stud rigidly attached to the elongate bar for insertion through the opening whereby the plates of the bar are disposed outwardly of the skirt with the distal ends of the plates near the flange of the pan;

an elongate flexible strand rigidly attached at a first end to a distal end of the threaded stud and extending through the opening in the pan for coupling the bar with the pan;

a nut received on the strand within the pan and sized for threadingly engaging the stud to fasten the bar to the bottom of the pan; and a handle attached to a second end of the strand for pulling the strand through the opening and thereby extending the threaded stud through the opening into the pan, whereby the pan, being supported by the flange on an upper surface of a frame in a manhole opening, is secured thereto by bearing the distal ends of the plates against a lower surface of the frame by engaging the nut to the stud within the pan, and the cover, being attached to the pan, substantially closes the central dish for restricting contaminants from the handle, nut, strand, and threaded stud within the central dish.

9. The entrance-deterring cap as recited in claim 8, wherein the coverplate is hingedly attached to the land portion of the pan.

10. The entrance-deterring cap as recited in claim 9, wherein the coverplate defines an opening in a perimeter portion; and further comprising a closer attached to the land portion, said closer being moveable from a first position for extending through the opening in the coverplate and a second position for securing the coverplate over the central dish.

11. The entrance-deterring cap as recited in claim 8, further comprising a seal on a surface of the coverplate for sealing between the coverplate and the land portion of the skirt, whereby the seal restricts entrance of contaminants into the central dish.

12. The entrance-deterring cap as recited in claim 8, wherein the threaded stud defines a transverse bore in a distal portion of the stud for receiving a shackle of a padlock therethrough after the nut is engaged to the stud to prevent unauthorized removal of the cap.

13. The entrance-deterring cap as recited in claim 8, further comprising a pair of spaced-apart U-shaped handles rigidly connected to the pan, for grasping and holding the pan during installation and removal from a manhole opening.

* * * * *

UNITED STATES PATENT AND TRADEMARK OFFICE

CERTIFICATE OF CORRECTION

PATENT NO. : 5, 951,200

DATED : September 14, 1999

INVENTOR(S) : David L. Barton

It is certified that error appears in the above-identified patent and that said Letters Patent is hereby corrected as shown below:

Column 1, line 7, after "1996" insert –, now U.S. Patent 5,827,007–.

Column 9, claim 8, line 8, change "as" to – at –.

Column 9, claim 8, line 27, change "cover" to – coverplate –.

Signed and Sealed this

Twenty-fifth Day of April, 2000

*Attest:*

Q. TODD DICKINSON

*Attesting Officer*

*Director of Patents and Trademarks*